US007059606B2

(12) United States Patent
Butcher et al.

(10) Patent No.: US 7,059,606 B2
(45) Date of Patent: Jun. 13, 2006

(54) GAME PLAYING METHODS AND GAME PIECE STACK FORMATIONS FOR PLAYING SAME

(75) Inventors: Stephen W. Butcher, Manson, MA (US); Paul Eveloff, Ross, CA (US); David Grebler, St. Louis, MO (US); Robert Grebler, Santa Monica, CA (US)

(73) Assignee: Pokonobe Associates, Ross, CA (US)

( * ) Notice: Subject to any disclaimer, the term of this patent is extended or adjusted under 35 U.S.C. 154(b) by 0 days.

(21) Appl. No.: 10/713,396

(22) Filed: Nov. 14, 2003

(65) Prior Publication Data

US 2005/0104298 A1 May 19, 2005

(51) Int. Cl.
*A63F 9/00* (2006.01)

(52) U.S. Cl. ..... 273/450

(58) Field of Classification Search ..... 273/440, 273/449, 450

See application file for complete search history.

(56) References Cited

U.S. PATENT DOCUMENTS

| | | | | |
|---|---|---|---|---|
| 107,352 | A | 9/1870 | Fitzgibbons | |
| 124,078 | A | 2/1872 | Ostrander | |
| 168,063 | A | 9/1875 | Taylor | |
| 1,307,331 | A | 6/1919 | Christoph | |
| 1,656,199 | A | 1/1928 | Hodgson | |
| 2,747,297 | A | 5/1956 | Zalkind | |
| 3,025,641 | A | 3/1962 | Ahtianinen | |
| 3,904,208 | A | 9/1975 | Grossman | |
| 3,911,634 | A | 10/1975 | Horowitz et al. | |
| 4,293,128 | A * | 10/1981 | Ebel | 273/450 |
| 4,303,240 | A | 12/1981 | Ellman et al. | |
| 4,522,393 | A * | 6/1985 | Dunn | 273/447 |
| 4,537,001 | A | 8/1985 | Uppstrom | |
| 4,723,382 | A | 2/1988 | Lalvani | |
| 4,753,622 | A * | 6/1988 | Nakama | 446/85 |
| 4,902,010 | A * | 2/1990 | Davis et al. | 273/450 |
| 5,067,729 | A * | 11/1991 | Hunter et al. | 273/450 |
| 5,611,544 | A * | 3/1997 | Grebler et al. | 273/447 |
| 6,022,026 | A * | 2/2000 | Johnson, III | 273/450 |
| 6,161,832 | A | 12/2000 | Holahan et al. | |
| 6,164,654 | A * | 12/2000 | Tricomi | 273/450 |
| 6,679,496 | B1 * | 1/2004 | Grebler et al. | 273/290 |
| 2002/0024180 | A1 * | 2/2002 | Dalton | 273/450 |
| 2002/0167130 | A1 * | 11/2002 | Grebler et al. | 273/290 |
| 2003/0006554 | A1 | 1/2003 | Grebler et al. | |

* cited by examiner

*Primary Examiner*—Raleigh W. Chiu
(74) *Attorney, Agent, or Firm*—Marshall, Gerstein & Borun LLP

(57) ABSTRACT

A method of playing a game includes providing a plurality of stackable game pieces, at least a proportion of which are parallelepiped game pieces having at least one pair of opposed non-right angle parallelogram end faces and at least one pair of opposed rectangular surfaces. The game pieces are arranged in a stack having multiple layers including an initial upper layer. The multiple layers include a plurality of parallelepiped layers formed from the parallelepiped game pieces which are rested on one of the rectangular surfaces and nested relative to one another in each respective parallelepiped layer. A selected game piece is removed from any layer of the stack other than the upper layer. The selected game piece is then replaced on top of the stack to reconfigure the game piece stack. The steps of removing and replacing are repeated by one or more players until a new upper layer is formed on top of the stack or until the stack topples. The steps of removing, replacing, and repeating are then subsequently repeated until the stack topples.

19 Claims, 9 Drawing Sheets

20
34
40
26
32
30
34
38
22
40
28
36

38
34
40
H
α
22
α
W
36
D 34
40
α
24
α
38
36

24
20
30
26
L
D
22

22
20
28
32
24

26
30
22
24
28

26
32
22
24
28

GAME PLAYING METHODS AND GAME PIECE STACK FORMATIONS FOR PLAYING SAME

BACKGROUND OF THE INVENTION

There are many known games that are relatively simple to play, employ a plurality of relatively uncomplicated game pieces, are entertaining to the players, and yet require a thoughtful strategy. One such game is known as JENGA® and includes a plurality of three-dimensional, elongate, rectangular, parallelepiped blocks of substantially the same size and shape. The particular method of playing a game using the JENGA® blocks can vary somewhat. In each example of a game playing method, a vertically oriented stack of the blocks is formed of multiple layers, each layer including multiple game pieces. The vertical stack is created and then blocks are removed one at a time from the stack and placed on top of the stack to form additional layers. This results in a continually reconfigured vertical stack of blocks that becomes taller and less stable during play.

SUMMARY OF THE INVENTION

The present disclosure is directed to game playing methods and to stacks of game pieces for playing games according to the disclosed methods. As disclosed herein, a stackable game piece can have an elongate parallelepiped body with a pair of parallelogram-shaped end surfaces. Each of the end surfaces can have a top edge, a bottom edge, and a pair of angled side edges. An elongate rectangular-shaped top surface can extend between the top edges of the end surfaces, and an elongate rectangular-shaped bottom surface can extend between the bottom edges of end surfaces. A pair of elongate rectangular-shaped side surfaces each can extend between the corresponding side edges of the end surface. The side surfaces can be oriented at an angle defined by an angle of the side edges of the parallelogram end surfaces of the game piece.

A stack of the game pieces can be formed by placing multiple layers of the game pieces one on top of the other. The stack can have a base or first layer that rests on a playing surface. The stack can also have an upper layer and a plurality of intermediate layers that are stacked between the first layer and the upper layer. Each layer can have an equal number of game pieces that are stacked, bottom surface to top surface, relative to adjacent layers. The game pieces within each layer can be positioned adjacent and similarly oriented to one another.

A game can be played by one player first removing a selected game piece from the stack. The removed game piece can be replaced on the top of the stack in a desired position and orientation. Depending upon the number of players and the various rules employed, the steps of removing and replacing are repeated until the stack topples over.

BRIEF DESCRIPTION OF THE DRAWINGS

The features and advantages of the present invention will be apparent to those of ordinary skill in the art in view of the detailed description of the preferred embodiment, which is made with reference to the drawings, a brief description of which is provided below.

DETAILED DESCRIPTION OF PREFERRED EMBODIMENTS

Figure 1:
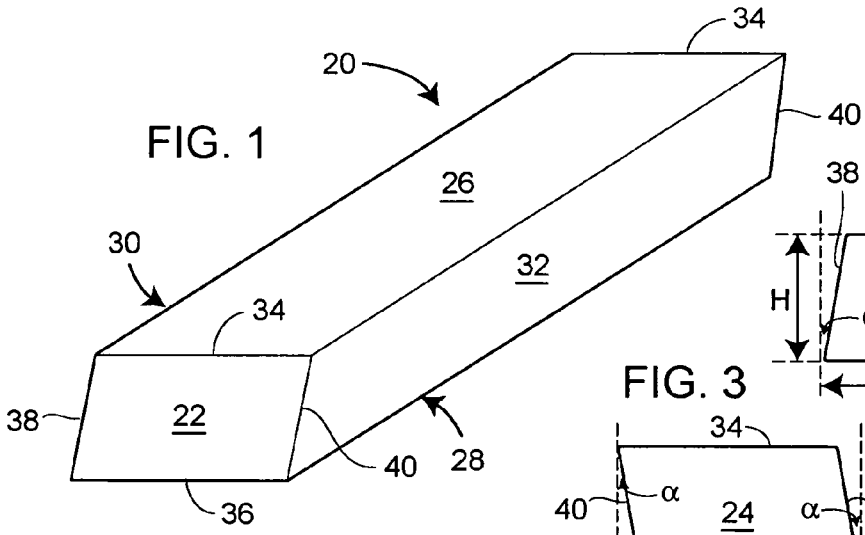
FIG. 1 illustrates a perspective view of one embodiment of a stackable game piece constructed in accordance with the teachings of the present invention.

The present disclosure is directed to an improved game piece, game piece stacks, and methods of playing a game utilizing a plurality of the game pieces arranged in a stack. The game includes providing a plurality of game pieces each having a three-dimensional, elongate parallelepiped shape with one pair of parallel but angled side surfaces. The angled side surfaces permit playing the game by forming a game piece stack or tower that can take on many configurations. Utilizing the disclosed game pieces, one can form a vertical stack, a leaning stack, or a myriad of different stack configurations with both vertical and leaning portions. The game methods involve stacking and then reconfiguring the stack until it topples.

Referring now to the drawings, FIGS. 1–7 illustrate one example of a stackable game piece 20 constructed in accordance with the teachings of the present disclosure. The game piece 20 is a parallelepiped-shaped block. The game piece 20 generally has a plurality of surfaces including first or front and second or rear opposed and generally planar end surfaces 22 and 24. The end surfaces 22 and 24 mirror one another, are parallel to one another, and are non-right angle parallelograms. The game piece 20 also has a top surface 26 and a bottom surface 28. The top and bottom surfaces 26 and 28 are also planar and parallel to one another, but are rectangular in shape. The game piece 20 further has an angled first or left side surface 30 and a second or right side surface 32. The side surfaces 30 and 32 again are planar and parallel to one another and are rectangular in shape.

Each of the parallelogram-shaped end surfaces 22 and 24 includes a top edge 34, a bottom edge 36, and a pair of side edges 38 and 40. In the disclosed example, the top and bottom edges are parallel to one another and spaced apart by a distance H that defines a height of the game piece. The top surface 26 extends between the top edge 34 of each of the end surfaces 22 and 24. The bottom surface 28 extends between the bottom edge 36 of each of the end surfaces 22 and 24. As shown in each of FIGS. 6 and 7, the top and bottom surfaces 26 and 28 are arranged generally perpendicular to the end surfaces 22 and 24. Thus, when viewed from the side, as defined herein, the game piece 20 appears to be an elongate rectangle. The distance between the end surfaces 22 and 24 defines a length L of the game piece 20.

Figure 2:
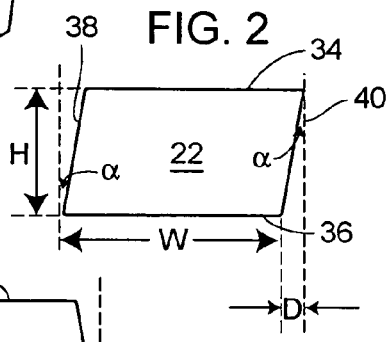
FIG. 2 illustrates a front end view of the stackable game piece as shown in FIG. 1.
Figure 3:
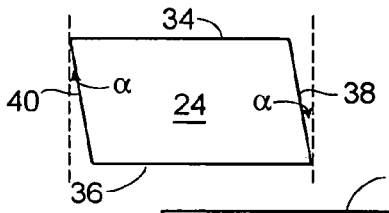
FIG. 3 illustrates a rear end view of the stackable game piece as shown in FIG. 1.
Figure 4:
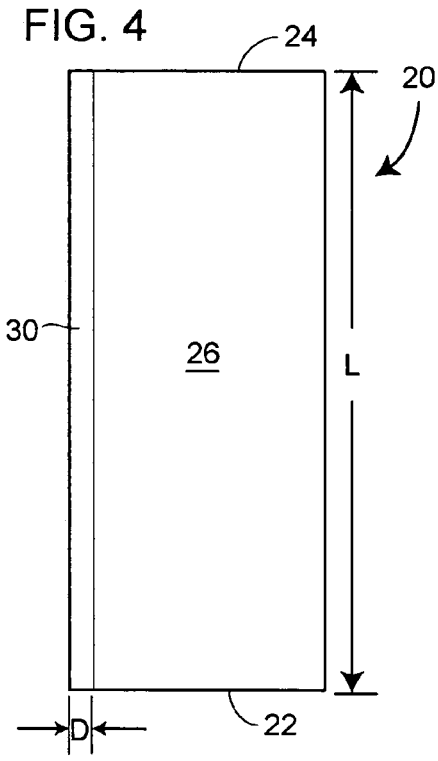
FIG. 4 illustrates a top view of the stackable game piece as shown in FIG. 1.
Figure 5:
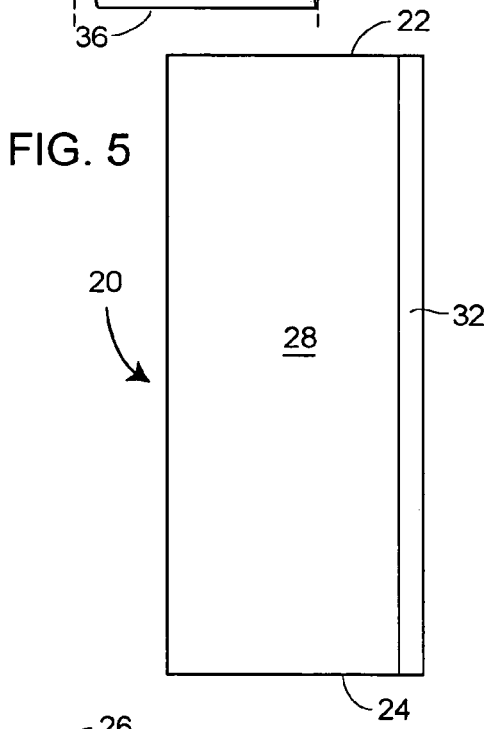
FIG. 5 illustrates a bottom view of the stackable game piece as shown in FIG. 1.
Figure 6:
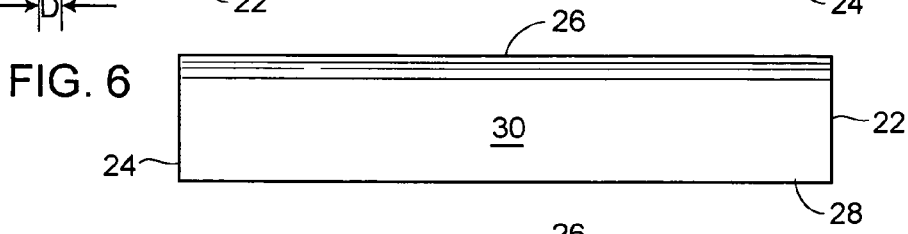
FIG. 6 illustrates a left side view of the stackable game piece as shown in FIG. 1.
Figure 7:
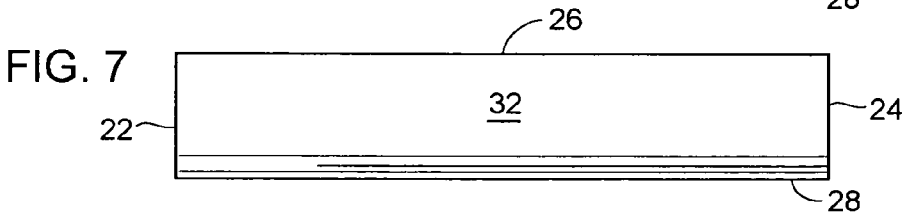
FIG. 7 illustrates a right side view of the stackable game piece as shown in FIG. 1.

The side edges 38 and 40 of each of the end surfaces 22 and 24 are oriented at an angle such that they are not perpendicular relative to the top and bottom edges 34 and 36. In one disclosed example, the angle $\alpha$ is measured from a reference line arranged normal or perpendicular relative to the top and bottom edges 34 and 36, as shown in FIGS. 2 and 3. As illustrated, the side edges 38 and 40 are oriented in a direction so that they are parallel to one another forming the parallelogram shape. In one example, the angle $\alpha$ is about 23°. This angle can vary within a manufacturing tolerance range, such as, for example, ±1.5°. This angle can also vary as desired from the 23° example, but is certainly greater than zero degrees and is preferably, though not necessarily, less than 45°. In one example, the angle $\alpha$ is between about 20° and about 25°.

The side surfaces 30 and 32 extend between the side edges 38 and 40, respectively, of the two end surfaces 22 and 24. Thus, the side surfaces 30 and 32 are angled according to the angle $\alpha$ relative to the top and bottom surfaces 26 and 28. As shown in FIGS. 2 and 3, a width W is defined by the width of the top and bottom surfaces 26 and 28. An actual width of the game piece 20 is wider than W because the top and bottom surfaces are offset a distance D created by the angle $\alpha$.

As utilized herein, the terms "top" and "bottom" are interchangeable, in that either the top surface 26 or the bottom surface 28 can face downward or upward while playing a game utilizing the game pieces. The terms are utilized herein for descriptive purposes only in order to describe relationships between game piece surfaces when stacked. Similarly, the first or front end 22 and the second or rear end 24 are interchangeable and the first or left and second or right angled side surfaces are also interchangeable with one another. Thus, the terms front and rear and the terms left and right, as used herein, are also used only for descriptive purposes. Such terms are not intended in any way to limit the game piece orientation or surface relationships beyond that disclosed herein. The orientation of the game piece 20 can vary when used to play a game. The game pieces 20 are essentially symmetrical in configuration.

As will be evident to those having ordinary skill in the art, the proportional relationships between the length L, width W, and height H of the surface dimensions of the game piece 20 as disclosed herein can vary and yet fall within the spirit and scope of the present invention. In the disclosed example, the width W is greater than the height H, and the length L is significantly greater than either the width W or height H. For example, the blocks can have a length L of about 3 inches, and in one particular example, the length L is 2.97±0.030 inches, the size range being for manufacturing tolerance. In this example, the width W is about 1 inch, and in one particular example is 0.98±0.020 inches, again, the range being for manufacturing tolerance. In this example, the width W is about one-third the length L. As a result, the stack or tower of the example described herein has a generally square footprint when each layer of a game piece stack is formed of three side-by-side game pieces.

In this same example, the height H is about ½ or 0.50 inches and, if desired, can be a more tightly controlled dimension for the pieces. In one particular example, some pieces can have a height of 0.546±0.005 inches and other pieces can have a height of 0.530±0.005 inches. The slight difference in height between certain pieces can be implemented to permit easier removal of the shorter height pieces from a stack as compared to neighboring taller height pieces. The height in this example is less than the width W. In the same example, the angle $\alpha$ is about 23°, which results in a lean or offset distance D that depends on the angle and the height H.

The present invention is not intended to be limited to the particular dimensional proportions illustrated in the drawings or described herein. The length L, width W, and/or height H can vary from the disclosed example without departing from the spirit and scope of the present disclosure. For example, the width W and height H can be identical to one another. This configuration would permit the game piece 20 to be set on any one of the four elongate surfaces, identified herein as top and bottom surfaces 24 and 26 and angled side surfaces 30 and 32, when playing a game.

In the disclosed example, since the width W is greater than the height H, the game can be played by resting the game pieces 20 on either the top or bottom surface 26 or 28. This will result in a more stable stack because each piece would essentially rest on a wider foot print, thus reducing the tipping moment of an individual piece. Alternatively, a game can be played by resting the game pieces on either of the narrower side surfaces 30 and 32. However, this will create a much less stable stack, making the game more difficult to play. If stacked in such a manner, the game pieces would have a narrow footprint, resulting in a greater tipping moment. As understood below, the top and bottom surface is identified as the surfaces which face upward and downward, respectively, when stacked during play. Therefore, if a game piece is stacked on either of the so-called side surfaces 30 and 32, or on its top surface 22, that surface effectively becomes the bottom surface for purposes of playing the game and for defining the spirit and scope of the present disclosure.

The game pieces 20 can be fabricated from virtually any material. As disclosed above, one suitable material is wood, and in one example is Alder wood. However, the pieces can be fabricated from other materials as desired, such as metal, plastic, or the like. Additionally, in another example, some of the game pieces can be provided from one material, and other of the game pieces can be provided from one or more different materials. It is known that different materials have different mass and/or weight characteristics. The mass and/or the weight of the game piece can affect the stability of a stack that is formed from game pieces 20 of different materials. Such an alternative can add further elements of strategy and game playing difficulty to the game.

Additionally, the angle α can have an effect on the tipping moment or stack stability. The greater the angle α, the more a game piece will lean in one direction. Stacking game pieces in layers creates multiple levels. The tipping moment of the layered stack can be either further increased or be offset as the stack gets taller and taller, depending on the orientation of the angled side surfaces within a given layer relative to other layers. This is further discussed below with reference to the game playing method and game piece stack alternatives.

The game pieces 20 permit a number of games and game variations to be played. These games can be played by any number of players. One person can play either for practicing playing the game or simply for personal amusement. Alternatively, two or more players can play against one another individually, or multiple players can be organized into teams which play one another.

The game pieces 20 can be stored in a container (not shown) or at least within a part of a tray (not shown) and spread out on a playing surface 48. The playing surface can be a substantially smooth, level, planar surface provided on part of the container or tray. Such a container or tray can be fabricated from cardboard, paperboard, metal, plastic, or virtually any suitable material, but would preferably define a substantially smooth surface 48 on which to play. In another example, the playing surface 48 can be any suitable and readily available horizontal surface, such as a table top or the like.

To begin a game in one example, one or more of the players can arrange the game pieces 20 to form a desired game piece stack. The stack configuration can vary as described herein, depending upon the level of difficulty and excitement desired by the player or players. FIGS. 8–14 each illustrate representative examples of the many possible stack configurations and are described successively below. A game playing method is later described utilizing the stack configuration of FIG. 8. The stack can be created to have a generally vertical orientation, a single direction leaning orientation, a multiple direction leaning orientation, or a combination leaning and vertical stack orientation.

Figure 8:
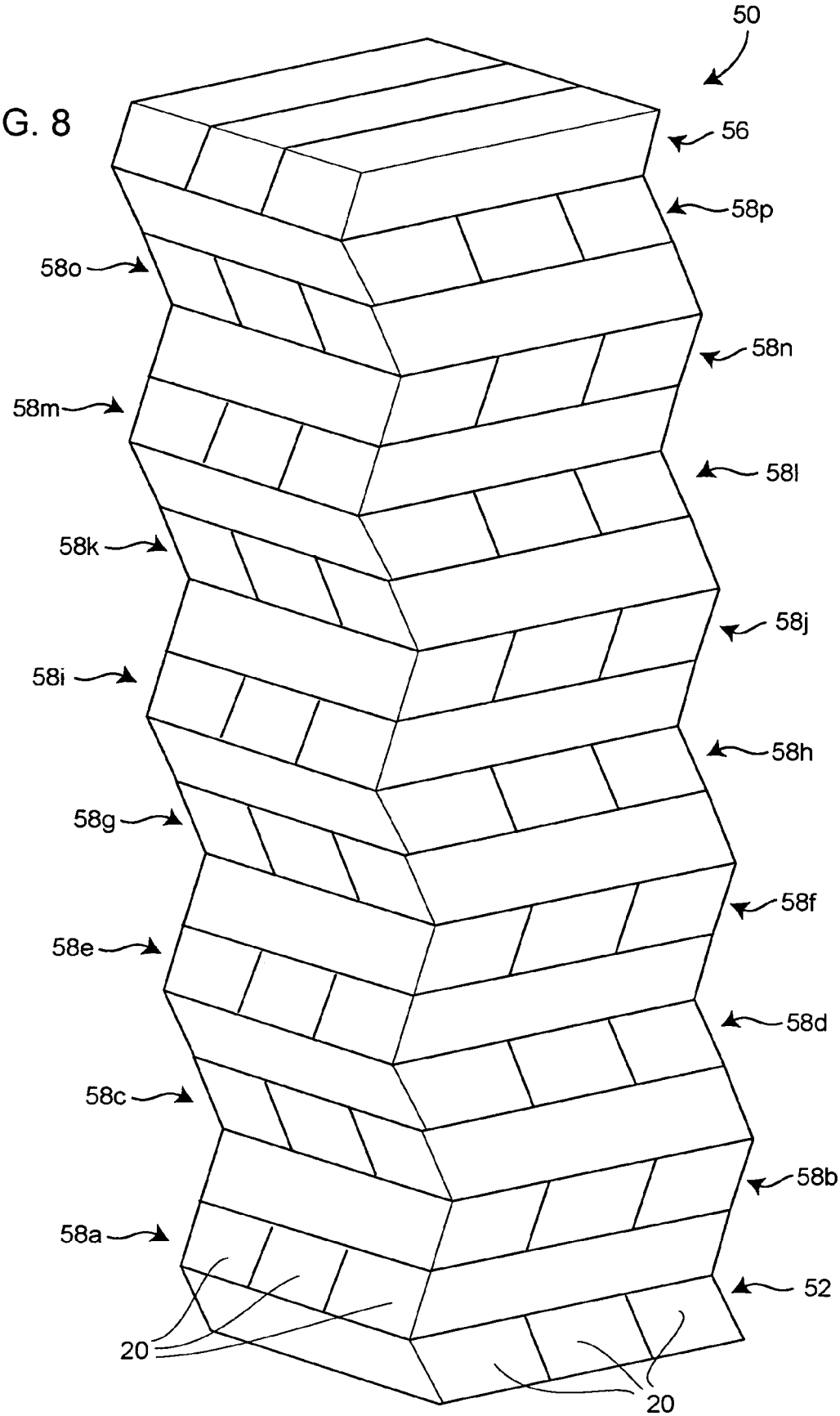
FIG. 8 illustrates a perspective view of a generic stack configuration formed of a plurality of the stackable game pieces as shown in FIG. 1.

As shown generically in FIG. 8, a game piece stack 50 that is generally vertically oriented can be created. In this example, the stack 50 can be created by arranging a first or base layer 52 of the game pieces resting on the playing surface 48. The base layer 52, in one example, can include three game pieces 20 that are laid side surface to side surface with the orientation of the adjacent angled surfaces matching one another such that the adjacent side surfaces closely nest with one another. As used herein, the term "nest" means that the adjacent side surfaces either bear fully against one another or at least are closely spaced and similarly oriented relative to one another. The stack 50 can include an initial upper layer 56 that also has, in this example, three game pieces 20. Again, the game pieces 20 in the initial upper layer 56 are laid side surface to side surface and abutting or nested with one another.

The disclosed stack 50 also can include a plurality of intermediate layers or levels 58*a*–58*x*, wherein "x" is representative of the actual number of intermediate layers 58. In one example, a game playing kit can include fifty-four of the game pieces 20. With a total of six pieces being used for the upper layer 56 and base layer 50, forty-eight pieces will remain. Thus, sixteen intermediate layers 58*a*–58*p*, as shown in FIG. 8, can be created sequentially on top of the base layer 52 until the upper layer 56 is completed. Each intermediate layer 58 has the same number of game pieces (three in this example) as the upper and base layers 56 and 52, respectively. Each intermediate layer 58 is stacked, bottom surface to top surface, with the game pieces of adjacent layers. The game pieces within each intermediate layer 58 are also positioned side surface to side surface adjacent and similarly oriented relative to one another.

Figure 9A:
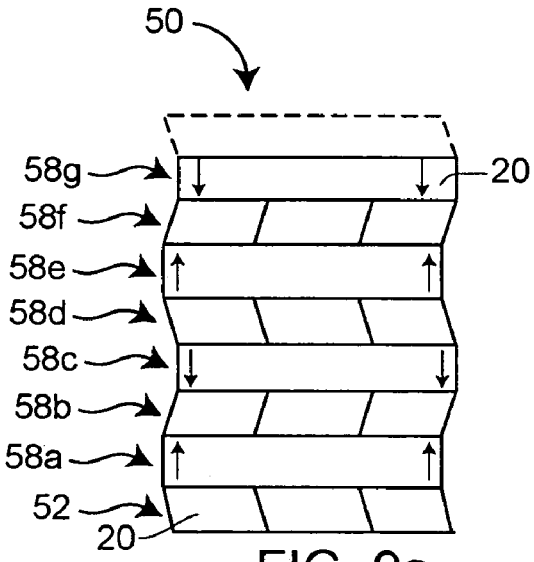
FIGS. 9*a* and 9*b* illustrate one example of a particular game piece stack configuration constructed in accordance with the teachings of the present invention.
Figure 9B:
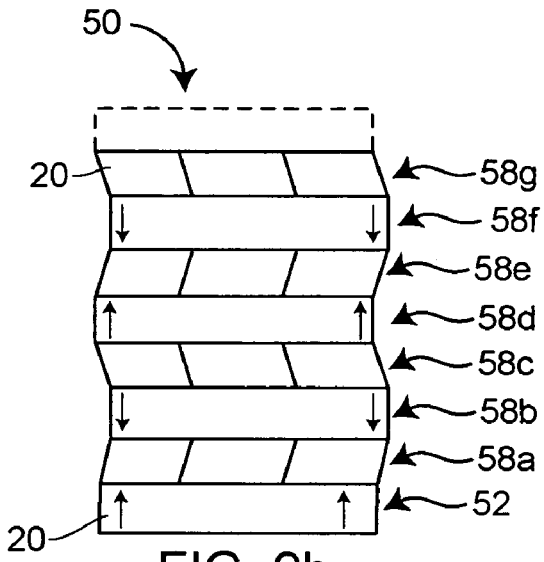

In one example, as illustrated generically in FIG. 8 and schematically in FIGS. 9*a* and 9*b*, the vertically oriented stack 50 can be formed in the following manner. The first or base layer 52 can be laid on the playing surface 48 with the game pieces positioned in a first lengthwise direction. The second layer 58*a* is laid on the first layer 52 with the game pieces 20 oriented in a second lengthwise direction that is transverse or 90° relative to the first lengthwise direction. The third layer 58*b* can be laid in the first lengthwise orientation (parallel to the base layer 52) with the game pieces oriented transverse or 90° relative to the second layer 58*a*. The third layer 58*b* can also be laid so that the angled surfaces 30 and 32 are oriented opposite to those of the base layer 52. The fourth layer 58*c* can be laid on top of the third layer 58*b* in the second lengthwise orientation (parallel to the second layer 58*a*) but with the angled side surfaces oriented opposite those of the second layer 58*a*. All of the layers including the final or upper layer 56 can be so arranged with the piece arrangement repeating every fourth layer. In this example, the pieces of each layer are aligned flush or edge to edge with the underlying layer, as depicted in FIGS. 9*a* and 9*b*. By arranging each layer at a right angle to the underlying layer, a more stable tower or stack is created.

The arrows used in FIGS. 9*a* and 9*b* are intended to identify the slant direction of the angled surface facing the viewer in the direction of the arrow. An upward arrow indicates that the surface being viewed is slanted away from the viewer in an upward direction. A downward arrow indicates that the surface being viewed is slanted toward the viewer in an upward direction. Further, the view shown in FIG. 9*b* is from the right side of FIG. 9*a*, and the view shown in FIG. 9*a* is from the left side in FIG. 9*a*. The same arrow and "a" and "b" representations apply to FIGS. 10–13 as well.

Figure 10A:
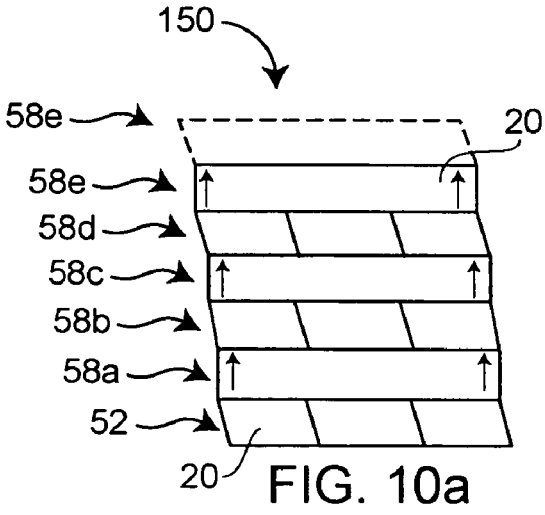
FIG. 10*a* and 10*b* illustrate another example of a particular game piece stack configuration constructed in accordance with the teachings of the present invention.
Figure 10B:
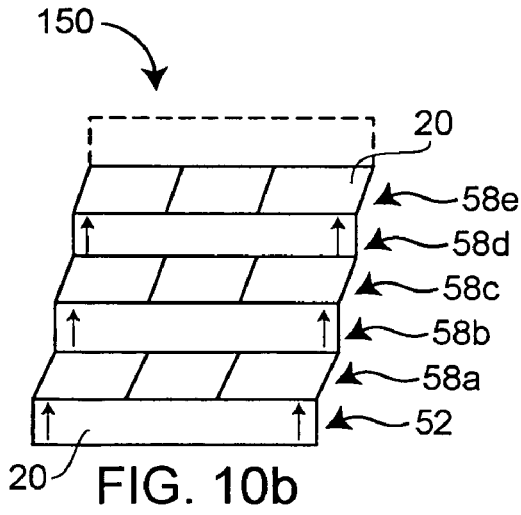

In another example, a leaning stack 150 can be formed as depicted schematically in FIGS. 10*a* and 10*b*. The first and second layers 52 and 58*a* can be laid in the same manner as for the stack 50. The third layer 58*b* can then be laid in the first lengthwise orientation, parallel to the base layer 52, but with the angled side surfaces 30 and 32 oriented in the same direction as the angled side surfaces of the first layer 52 game pieces. Similarly, the fourth layer 58*c* can be laid in the second lengthwise orientation, parallel to the second layer 58*a*, but with the angled side surfaces oriented identically to the side surfaces of the second layer 58*a* game pieces. To form a leaning stack 50 having this configuration, the pieces 20 in each layer are again aligned flush or edge to edge with the underlying layer. The stack lean angle will be a function of the angle α and will depend on the game piece arrangement and the direction of measurement relative to the tower or stack. In this example, the lean angle will be about ½α if measured relative to a plane determined by either of the two sides oriented at an acute angle relative to the playing surface.

Figure 11A:
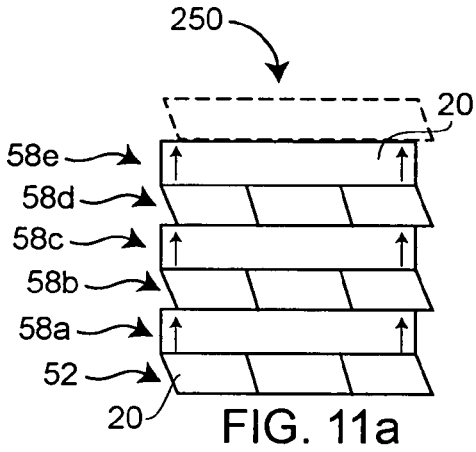
FIGS. 11*a* and 11*b* illustrate another example of a particular game piece stack configuration constructed in accordance with the teachings of the present invention.
Figure 11B:
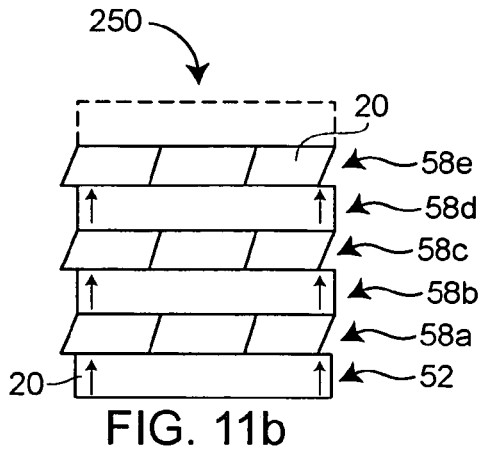
Figure 12:
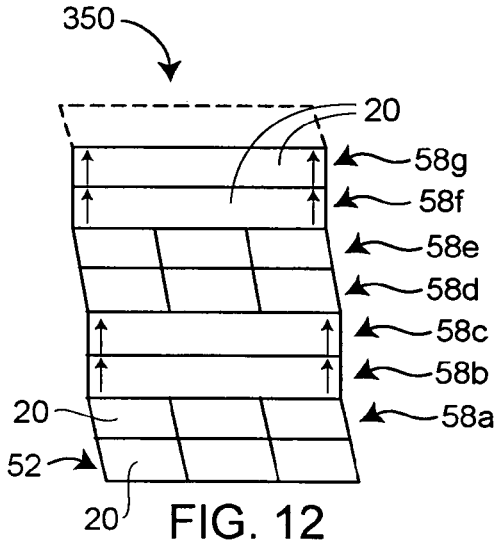
FIG. 12 illustrates another example of a particular game piece stack configuration constructed in accordance with the teachings of the present invention.
Figure 13:
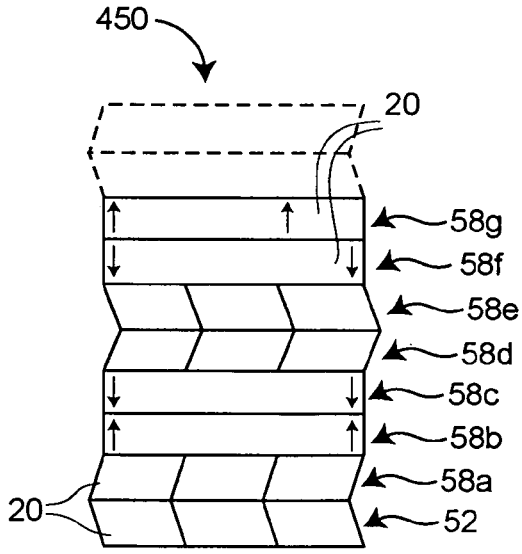
FIG. 13 illustrates another example of a particular game piece stack configuration constructed in accordance with the teachings of the present invention.

FIGS. 11*a* and 11*b* illustrate one possible alternative stack configuration that is created using the same arrangement method used for the stack 150 in FIGS. 10*a* and 10*b*, except that the pieces 20 of each layer are not laid flush or edge to edge with the underlying layer. In this example, a generally vertically oriented stack 250 can be created by offsetting each successive layer from the next lower layer by the distance D in order to compensate for the angle α. To illustrate, the first and second layers 52 and 58*a* are again laid transverse to one another as described above. However, the end surfaces 30 and 32 are positioned on the exposed top surfaces 24 but offset a distance D from the edges in order to compensate for the "overbite" created by the angle α. The third and fourth layers 58*b* and 58*c* are similarly laid and offset a distance D. In this way, each alternating layer will be positioned in essentially the same vertical plane such that the resultant stack 250 is vertically oriented.

Figure 14:
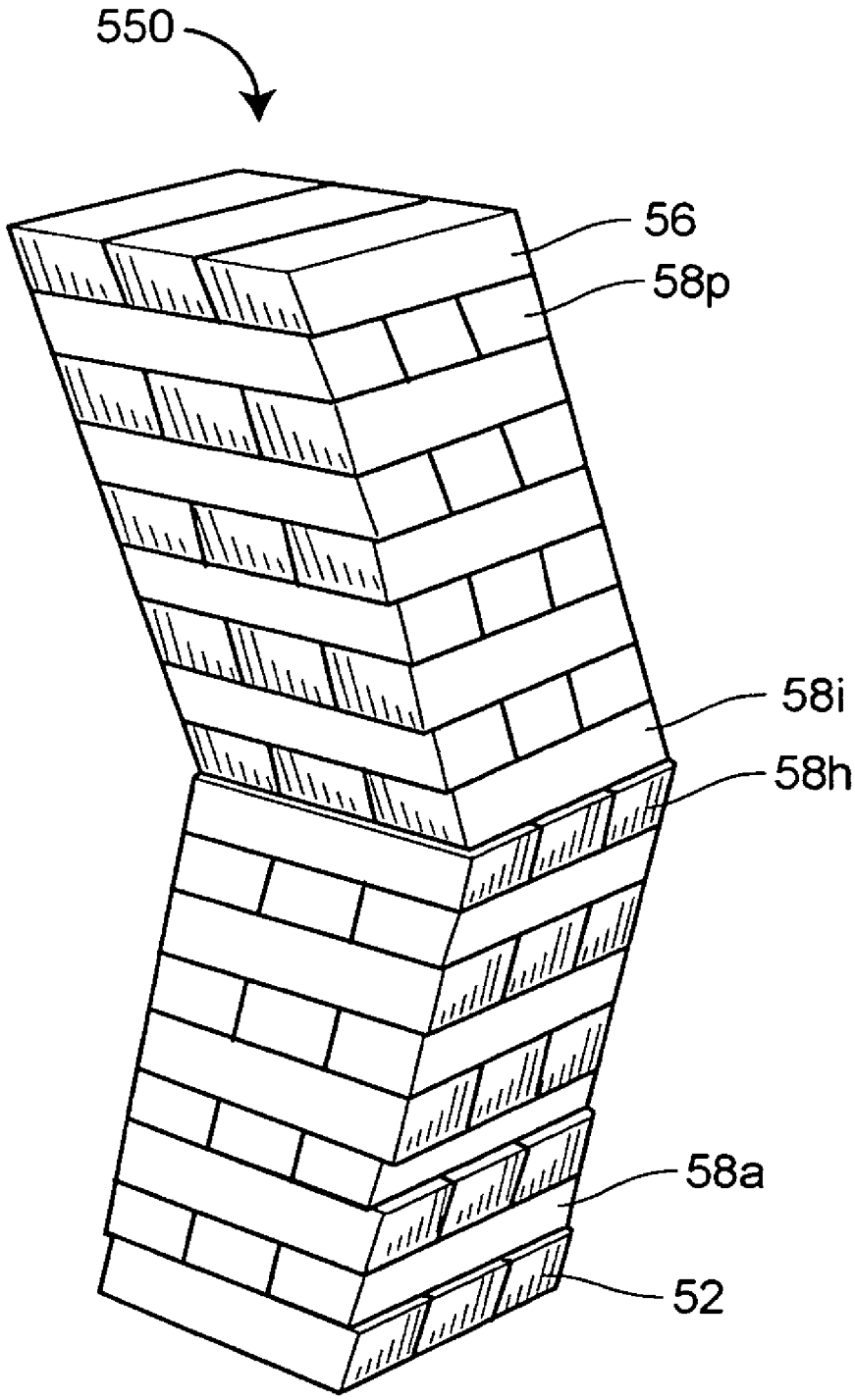
FIG. 14 illustrates another example of a particular game piece stack configuration constructed in accordance with the teachings of the present invention.

As will be evident to those having ordinary skill in the art, many variations and/or combinations of the above stacking configurations can be achieved without departing from the spirit and scope of the present invention. Still other stack examples are also possible to achieve. For example, two adjacent layers can be arranged having the same lengthwise orientation, and then each such layer pair can be arranged perpendicular to similar adjacent layer pairs. Each of such layer pairs can be arranged having the angled surfaces of its game pieces either in the same orientation (stack 350 in FIG. 12) or in opposed orientations (stack 450 in FIG. 13). FIG. 14 illustrates one example of a combination stack 550. In this example, the layers 52 and 58*a*–58*h* are arranged leaning in a first direction and formed using the example depicted in FIGS. 10*a* and 10*b*. The layers 58*i*–58*p* and 56 are arranged leaning in a second opposite direction, but formed using the same method Many alternative stack configurations are possible without departing from the spirit and scope of the invention. There is no right or wrong way to build a stack, as long as each piece 20 in each layer nests with its adjacent pieces in its layer (i.e., same angled surface orientation and generally abutting one another.

A number of game playing methods and variations can be played utilizing the above game pieces 20 and stacks 50, 150, 250, 350, 450, and 550 and are now described. In one example, the pieces 20 are emptied onto the desired flat surface 48. The stack can then be constructed, for example, by one or more of the players and/or teams. Once a stack is constructed, a designated player begins the game with a first move. Each player can make a move, taking turns with the other players or teams, if multiple players and/or teams are participating. Pieces are removed, one at a time, and stacked on top of the stack to create new layers. Once each player and/or team has made a move, one round is completed. The game concludes when the stack topples. The disclosed game playing method can be different every time the game is played. A unique stack or tower can be created to start each game, and will be created during play as described below. As the tower or stack changes during play, the game becomes more extreme, challenging, and exciting because the stack's center of gravity will shift as it becomes taller and its configuration shifts.

The players can sit around the stack, forming a ring if enough players, and can determine the order of play for each round. Once a round of play is completed, next subsequent rounds can be performed using the same order of play or different orders, as desired. For example, each subsequent round can be the reverse order of play of the prior round. Play can move from player to player with one player making a move and, for example, the player to their left or their right making the next move. Rules can also be developed that define the order of play, either for individuals or for teams. Rules can also be developed that define who makes the first move of the game, or the players or teams can make the determination. For example, the player that built the stack can then either make the first move, designate who makes the first move, and/or make the last move in a first round. Alternatively, in another example, either the youngest or the eldest player can be the one designated to make the first move, or the player toppling the stack and losing the last game can be so designated.

To make a move, a player selects and removes a game piece 20 from the stack below the highest completed or upper most layer. For the first move, the player will remove a piece from any chosen layer other than the upper layer 56. For any move, the player removes a selected piece 20 and then replaces the removed piece on top of the stack in a required or a desired position and orientation, according to the rules of the particular game. If a new top layer is not yet complete, the player should assure that the replaced piece 20 is positioned such that a new layer can be completed during subsequent moves. For example, the player can assure that the replaced piece nests with any adjacent pieces in the top layer. In one example, the player can be required to place the removed piece on top of the stack transverse or 90° relative to the underlying layer. Such would be the case for the stacks 50, 150, 250, and 550 disclosed herein. The rules can also require that a player use only one hand to remove and replace a piece 20 from the stack.

A player can be permitted to remove a piece from anywhere in the stack beneath the top complete player or from a particular part of the stack, depending on the rules. The rules may require that a particular player cannot remove and replace a game piece 20 that has either just been placed by another player, or that was last removed and replaced by this particular player in order to advance the game to a conclusion. The rules should require that removal of game pieces can only take place from below the highest completed level during play. Also, the rules may require that the game pieces being replaced on top of the stack must follow the lengthwise orientation pattern of the stack. Alternatively, the rules may permit a player to replace their removed piece in any position and orientation on the stack, regardless of the arrangement or type of pieces in underlying layers. The stack can, thus, become virtually any shape and configuration imaginable as a result of the angled surfaces 30 and 32 of the parallelepiped game pieces.

Further, the rules may require that a player fix any piece touched and shifted, though not removed while trying to select a piece for removal. The rules should also, but need not, require that each new level or layer being formed during replacement of removed pieces be completed before a new layer is started on top of the stack. The rules can also determine a time limit for making a move, for the next player to make a move after the last player, and/or for the stack or tower to stay up after a move is made. The game playing kit can come with play instructions and/or a timer with selectable settings. The players can make the game more difficult by, for example, limiting the amount of time each player has to make a move or by gradually reducing the allotted time as the game progresses.

The steps of selecting, removing, and replacing game pieces are repeated by each player in each round until the stack topples. The rules can vary, but a player loses if the stack topples upon either their removing a selected piece or replacing the selected and removed piece. The rules can be such that the winner is the last person to make a move without toppling the stack. Alternatively, if three or more players are playing, the player responsible for toppling the stack can be eliminated from further competition, and then the entire game, from building to toppling, can be repeated with the remaining players.

Figure 15:
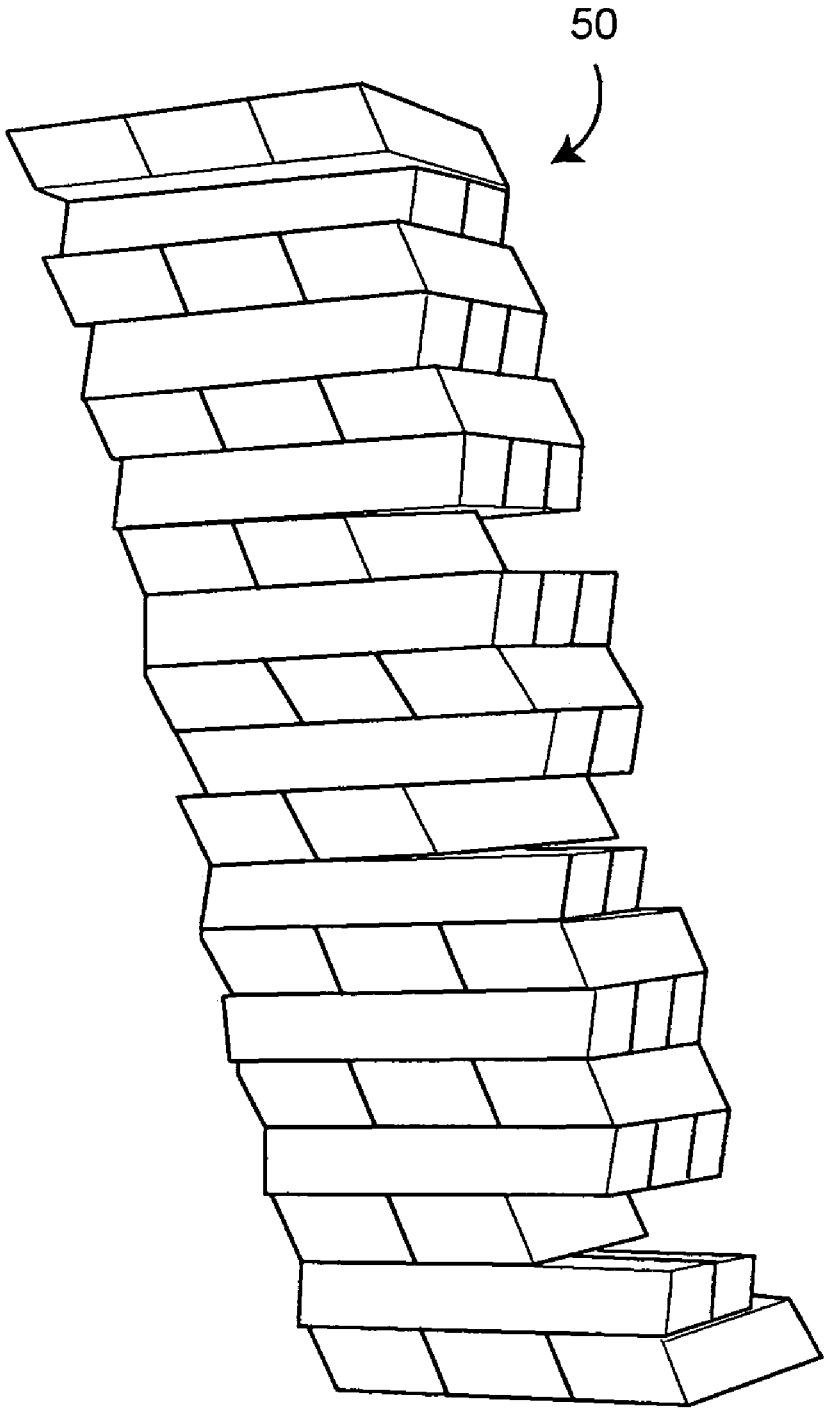
FIG. 15 illustrates an example of a game piece stack shown during play in accordance with the teachings of the present invention.
Figure 16:
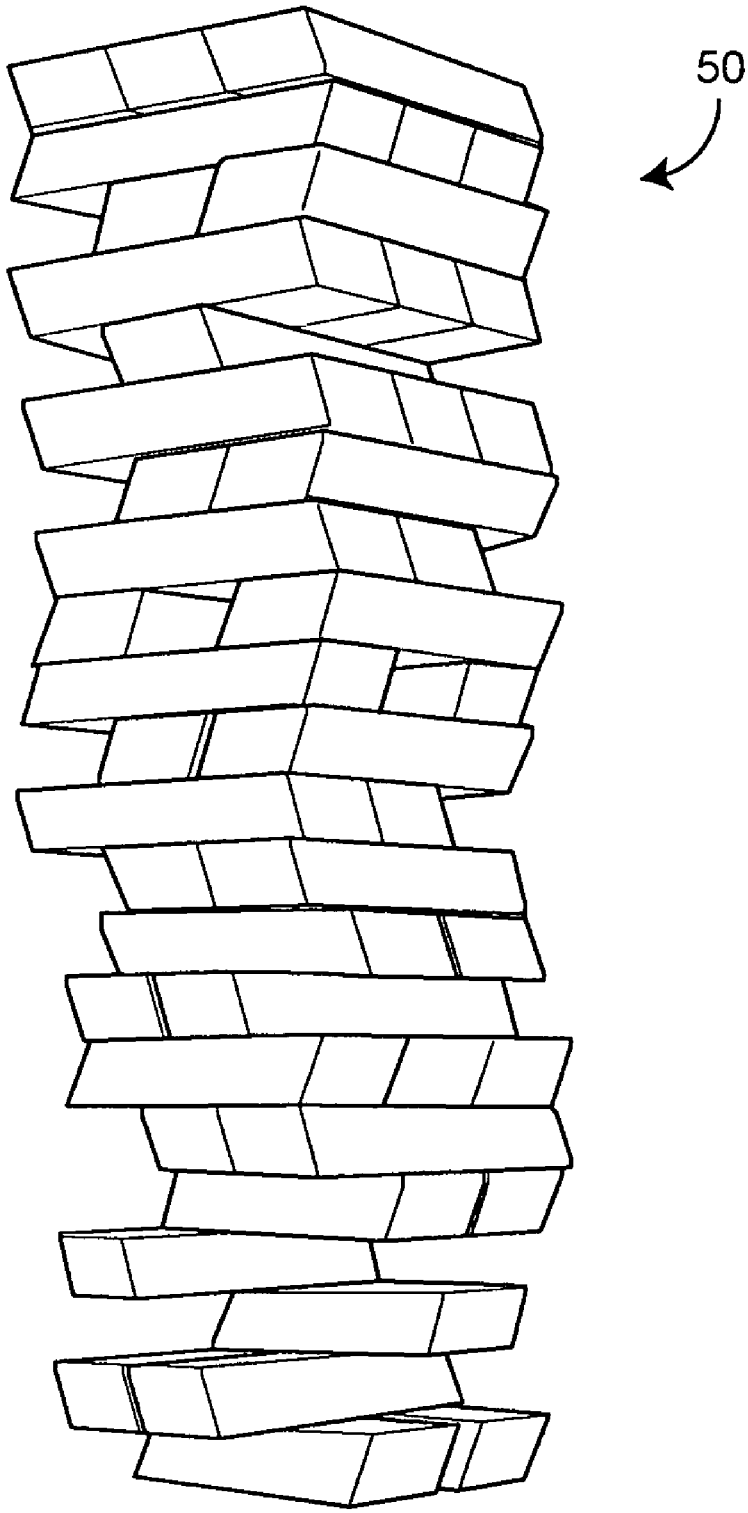
FIG. 16 illustrates another example of a game piece stack shown during play in accordance with the teachings of the present invention.

The game utilizing the game pieces 20 can be fun and enjoyable, as well as difficult to play because the stack can be made to lean at least over a portion or over the entire height of the stack to begin play. The configuration and lean of the stack can and will also change during play, making the game unpredictable, challenging, and exciting. Representative examples of in-play stack configurations are illustrated in FIGS. 15 and 16. The lean angle and stack configuration will be determined by the angle of the side surface 30 and 32 as well as the piece arrangement employed during a particular game. Because of the stack angle variation and the ever-changing stack configuration during play, the center of gravity of the stack or tower will constantly shift. Some pieces may become looser and easier to remove, while others may become compressed and more difficult to lodge free. The rules can permit players to touch pieces to determine if they are loose. The rules can also require the players to fix any moved, but not removed pieces during play.

The disclosed game methods will require each player to employ strategy and skill in order to maintain the stack in balance both when removing a selected piece and while replacing the piece on top of the stack. Because of the disclosed parallelepiped game piece shape, a player must consider the stack balance, both before removing a piece and in deciding where to replace the piece, in order to successfully make a move during the game.

Many other game variations can also be employed. For example, the game pieces 20 can be provided in different color sets. The different colored pieces can be utilized to create many different game playing strategies. The rules may require that each layer have one piece of each color or be formed of the same color for the starting stack and/or for the changing stack during play. In another example, the rules may require a player to select a piece of a different color from that of the prior move. In still another example, the players may be required to select a piece of a particular color during a given move. The color selection can be determined in any number of ways, including requiring the other players to select the color for the player taking a turn, or requiring selection of particular colors in a given order during the game. Alternatively, the colors can be designated to each individual player so that they can only select a piece of their color, or that they can only select a piece that is not their color. The colors may also be associated with variations in game piece height, if desired, and as described above. This would make the smaller and larger pieces easier to identify and more or less enticing to a player to select for removal, adding even more strategy to the game.

As noted above, the rules may require that a player only use one hand to select, remove, and replace a piece. The rules may also require a player to use the same hand for removal and replacement, or to switch hands during a move or every other move. Further, in one example, the players can be required by the rules to be positioned at particular spots around the stack. In order to access a given side of the stack, the players can be required to rotate the stack, making the game even more difficult. Many rule variations may be conceived of and employed that fall within the scope and spirit of the present invention.

In yet another example, a proportion of the game pieces can include a marking or indicia on one or more of the game piece surfaces. The indicia, if found on a selected game piece, can either require the selecting player to perform a particular task or produce or require some other result. In one example, the indicia can simply be a dot (not shown) that requires a particular action to take place. For example, if a player removes a game piece 20 that has such an indicia, the game rules may require that player to rotate the stack in one direction or another.

Figure 17:
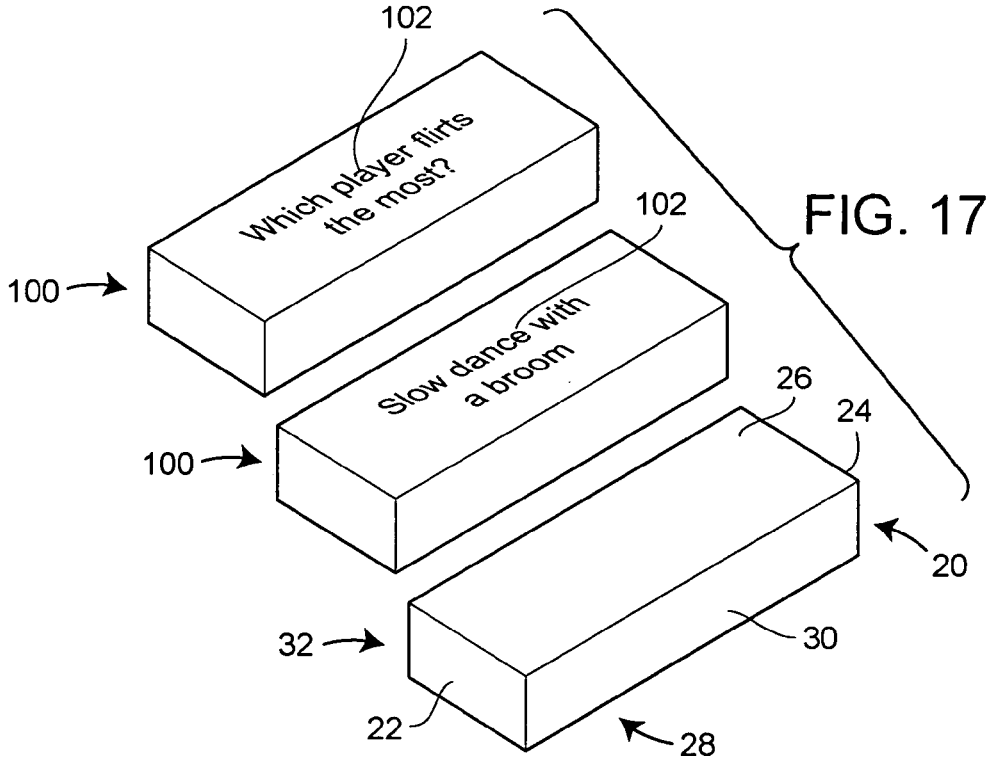
FIG. 17 illustrates an example of a game piece stack wherein at least some of the game pieces include indicia on various surfaces for playing a game incorporating the indicia into the game during play.
Figure 18:
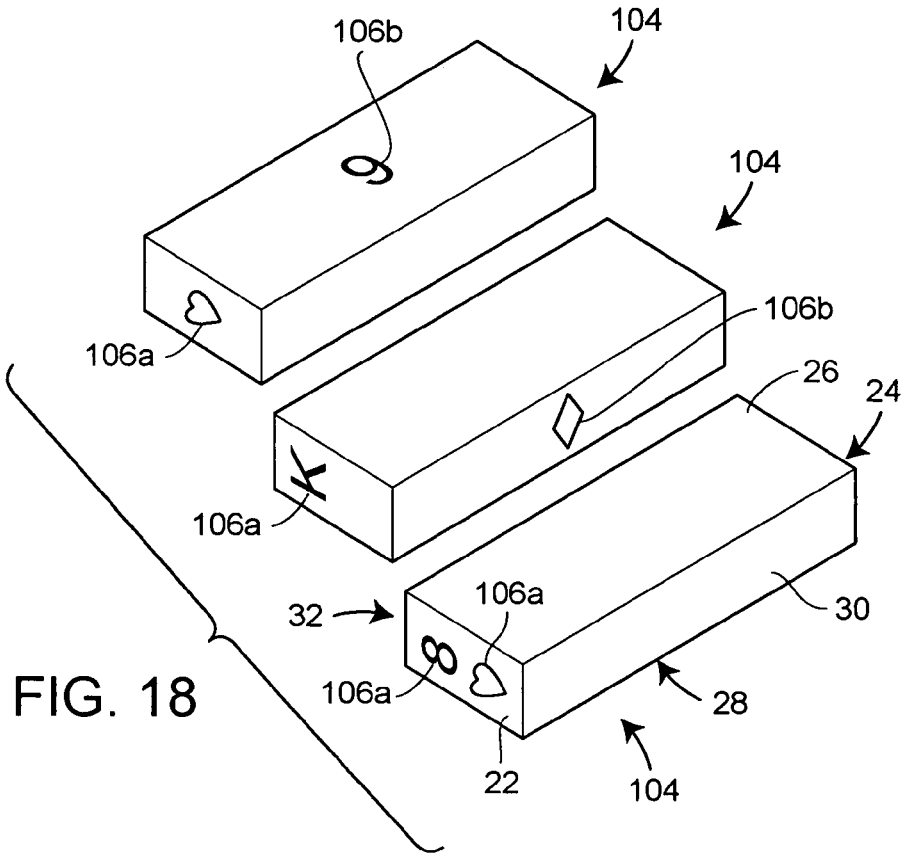
FIG. 18 illustrates another example of a game piece stack wherein at least some of the game pieces include alternative indicia on various surfaces for playing a game incorporating the alternative indicia into the game during play.

A number of indicia variations are possible and are represented in FIGS. 17 and 18. For example, FIG. 17 illustrates three representative game pieces 100 with indicia 102 on the top surface 26 or bottom surface 28. In this example, the indicia 102 will not be visible until a piece 100 is removed from a stack (not shown). The indicia 102 can be letters, words, or phrases and can indicate a particular task class or act required of the player removing the piece, or can provide some benefit or authority to the player, for example. In one example known as JENGA® Truth or Dare, the indicia can indicate a task class for one or more of the players, provide a question for one or more of the players to answer within the class, or provide a risk class option for the player to perform. In another example, a question from a "truth" class can be on one side and an act from a "risk" class can be on the opposite side. The player can either answer the question on one surface of the piece or take the dare on an opposite piece surface. U.S. Patent Application Publication No. US 2002/0167130 A1 describes variations of this particular example, and is incorporated in its entirety herein by reference. As will be evident to those having ordinary skill in the art, the indicia for top and bottom surfaces of the pieces, and game requirements and/or results stemming from such indicia can vary considerably.

FIG. 18 illustrates another example of a game piece 104 wherein indicia 106 is also placed on the end surfaces 22 and 24 on the side surfaces 30 and 32. Indicia 106*a* on the end surfaces would always be visible, and indicia 106*b* on the side surfaces would sometimes be visible, depending upon piece location within a particular layer. The indicia 106 can be placed either only on certain selected surfaces or on surface combinations, as desired. As a result, the indicia 106 may be visible at all times (end surfaces), sometimes (side surfaces), or only when removed from the stack (top and bottom surfaces). Variations and combinations of different indicia can be utilized to create many additional strategic twists and turns to a game played according to this disclosure. The visibility of the indicia can be manipulated and relied upon for a wide variety of game rules and objectives.

In one example known as JENGA® Jacks, the game kit can include game playing accessories, such as for example, a set of cards, which coincide with indicia 106*a* on the end surfaces 22 and 24 of the pieces. The accessories can correspond to the indicia and, for example, the game cards, can match the indicia. The rules of the game can dictate what a player is to do with the accessories, depending upon which indicia is on a game piece they select. For example, if a player removes a piece matching one of their game cards, the rules may permit them to discard that card. A player's remaining hand can also be utilized to calculate a score, or a portion of a score, at the termination of a game. U.S. Patent Application Publication No. US 2003/0006554 A1 describes variations of this particular example, and is incorporated in its entirety herein by reference. Many different games can be contrived using various indicia and related game playing accessories.

Other game variations are also possible. In still a further example, a game utilizing game pieces of two or more different shapes can be played wherein only some of the pieces are parallelepiped pieces as disclosed herein. The previously described examples all utilized essentially the same parallelepiped shaped pieces. For a particular game in this additional example, the rules may require the stack to be constructed with each layer having the same game piece characteristics, i.e., same shape, but with some layers formed of shaped different pieces.

Figure 19A:
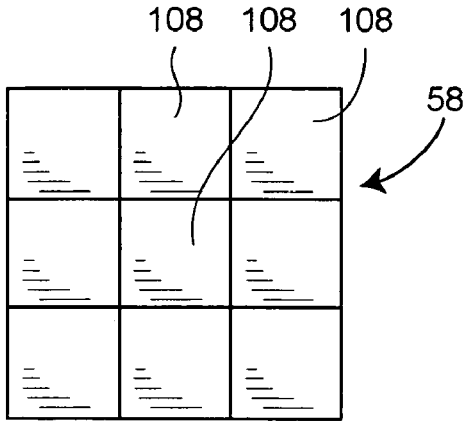
FIGS. 19*a*–19*c* illustrate alternative examples of game piece stacks wherein a proportion of the game pieces are of different shape relative to the remaining game pieces, which are as shown in FIGS. 1–7.
Figure 19B:
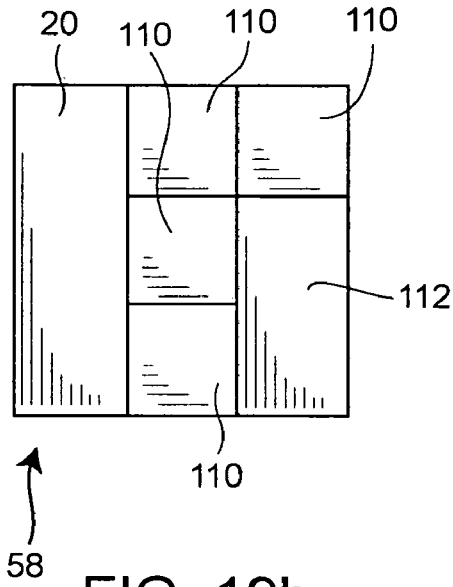
Figure 19C:
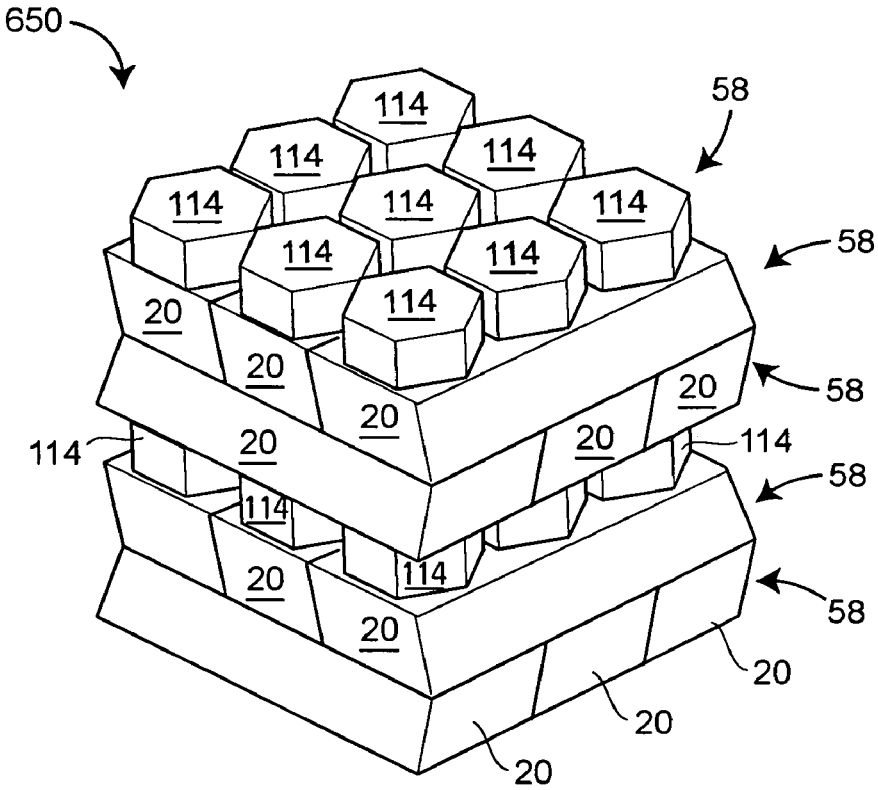

For example, FIGS. 19*a*–19*c* illustrate various different game piece stacks that incorporate layers of different game pieces, or different game pieces within a given layer. Examples of such game pieces, stacks, and playing methods are disclosed in U.S. Pat. No. 5,611,544, which is incorporated in its entirety herein by reference.

In FIG. 19*a,* one or more layers 58 of a stack (not shown) can be fabricated from square game pieces 108. The square pieces 108 can have the same height as the pieces 20 disclosed herein. This would permit them to be used in layers having one or more parallelepiped pieces added to the top of a stack during play. The square pieces could be of different height, which would require the pieces to be removed and replaced at least in numbers sufficient to create a completed square piece layer on which parallelepiped or other shaped game pieces could be stacked.

FIG. 19*b* illustrates one example of a layer 58 incorporating different length game pieces, thus yielding pieces of different shape. Each game piece 20, 110, or 112 is a parallelepiped such that the pieces can nest together side-to-side. The pieces are constructed such that uniform layer sizes can be arranged utilizing the different length pieces 20, 110, and 112. In this example, some pieces are the disclosed pieces 20. The other pieces in this example include those pieces 110 having one-third the length L of the pieces 20, and those pieces 112 having two-thirds the length L of the pieces 20. Different proportional length pieces can be utilized as well. This example will incorporate additional strategy into the game, both when building the stacks and when removing pieces while playing a game. A player will have to decide what size piece to remove and the ramifications of doing so when making a move. In this example, a player may not be able, at least for middle pieces in a layer, to determine the length of a piece selected for removal. Depending upon the size of the piece removed, a player would also have different options available for replacing a shorter length piece on top of the stack.

FIG. 19*c* illustrates a portion of a game piece stack 650 utilizing different shape game pieces 114 within a given layer 58. In this example, hexagonal pieces 114 with six sides, a top, and a bottom are shown forming several of a plurality of layers 58 of the stack 650. Again, the pieces 114 in this example can have a height H that is the same as the height of the pieces 20, permitting mingling of pieces within a given layer, if desired. Clearly, many different sizes, shapes, and configurations of game pieces can be mixed with the pieces 20 disclosed herein to create an exciting, challenging game.

All of the above variations and modifications add complexity, excitement, difficulty, and different challenges to the basic game playing method disclosed herein. Many of the variations can be utilized alone or in combination with other variations in conjunction with the parallelepiped game pieces and stacks disclosed herein.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A reconfigurable game piece stack arranged for playing a game, the stack comprising:

a plurality of game pieces, at least some of the game pieces comprising parallelepiped-shaped primary game pieces, each primary game piece having a pair of opposed non-right angle parallelogram end faces, each of the end faces having a pair of angled edges intersecting a top edge and a bottom edge at an angle $\alpha$, or each primary game piece further including parallel rectangular top and bottom surfaces, the top and bottom surfaces offset relative to one another by an offset distance D, each primary game piece further including first and second parallel angled side faces positioned to intersect a corresponding one of the angled edges of each of the end faces;

multiple layers of the game pieces vertically stacked, the multiple layers comprising at least one lower layer and at least one upper layer, at least some of the multiple layers comprising a first, second, and third primary game pieces disposed immediately adjacent one another with the first side face of a first of a primary game piece abutting the second side face of the second primary game piece and with the first side face of the second primary game piece abutting the second side face of the third primary game piece to form a parallelepiped layer, a portion of the first primary game piece overlying a portion of the second primary game piece in the same layer by a distance equal to the offset distance D, and a portion of the second primary game piece overlying a portion of the third primary game piece in the same layer by a distance equal to the offset distance D, the top rectangular surfaces of at least one of the lower layers forming a support surface for at least one of the upper layers ; and at least one of the game pieces in a selected one of the lower layers being selectively removable from the game piece stack to leave at least one other primary game piece remaining in the selected lower layer thereby altering a tipping moment of the game piece stack.

2. The game piece stack of claim 1, wherein the end faces are separated by a distance L, the rectangular top and bottom surfaces have a width W measured perpendicular to the distance L, and the top and bottom rectangular surfaces are separated from one another by a distance H, and wherein a ratio of L to W is about 3:1, and wherein a ratio of W toll is about 2:1.

3. The game piece stack of claim 2, wherein the angle $\alpha$ measures about 20 to 25 degrees relative to a reference line extending perpendicular to the top and bottom surfaces.

4. A reconfigurable game piece stack according to claim 1, and including only primary game pieces in the stack.

5. A reconfigurable game piece stack according to claim 4, further comprising fifty-four of the game pieces stacked in eighteen layers.

6. A reconfigurable game piece stack according to claim 4, wherein each of the primary game pieces includes a length L measured between the end faces, and wherein the length L of each of the primary game pieces in one layer is oriented perpendicular to the length L of each of the primary game pieces in the next vertically adjacent layer.

7. A reconfigurable game piece stack according to claim 1, wherein the tipping moment of the stack can be changed by removing the selected game piece from the stack and placing the selected game piece on top of the stack.

8. A reconfigurable game piece stack according to claim 1, wherein each of the non-right angle parallelogram end faces of the primary game pieces has a pair of side edges oriented at an angle of about 20° to about 25° relative to a reference perpendicular to top and bottom edges of the end faces.

9. A reconfigurable game piece stack according to claim 1, wherein at least a fraction of the primary game pieces has a height H that is different than the height H of the other primary game pieces, making some of the primary game pieces either easier or more difficult to remove from the stack than other of the game pieces.

10. A reconfigurable game piece stack according to claim 1, wherein the multiple layers of the stack are arranged such that at least a portion leans relative to vertical.

11. A reconfigurable game piece stack according to claim 1, wherein at least a fraction of the primary game pieces are provided of one color that is different than a color of the other primary game pieces.

12. A reconfigurable game piece stack according to claim 1, wherein at least a fraction of the primary game pieces are provided having an indicia on at least one end face or side surface.

13. A reconfigurable game piece stack according to claim 12, wherein the indicia are selected from either words or symbols.

14. A reconfigurable game piece stack according to claim 1, wherein at least a proportion of the plurality of game pieces are secondary game pieces each having a shape that is different than the primary game pieces.

15. A reconfigurable game piece stack according to claim 14, wherein the secondary game pieces are not parallelepiped shaped.

16. A reconfigurable game piece stack according to claim 14, wherein a proportion of the multiple layers includes one or more of the secondary game pieces.

17. A reconfigurable game piece stack according to claim 14, wherein the multiple layers include at least one layer formed of only the secondary game pieces.

18. A reconfigurable game piece stack according to claim 1, wherein the plurality of game pieces are made from a wood material.

19. A reconfigurable game piece stack arranged for playing a game, the stack comprising:

a plurality of parallelepiped-shaped primary game pieces, each of the primary game pieces having a pair of non-right angle parallelogram end faces, the end faces aligned with and parallel to one another, each of the end faces having an upper edge, a lower edge, and a pair of angled side edges intersecting the upper and lower edges at an angle $\alpha$, the angle $\alpha$ being non-perpendicular;

each of the primary game pieces further including a rectangular top surface and a rectangular bottom surface, the top surface intersecting the upper edge of each of the end faces and the bottom surface intersecting the lower edge of each of the end faces, the top surface and the bottom surface offset horizontally relative to one another by an offset distance D;

each of the primary game pieces further including a pair of elongate angled side surfaces, each of the angled side surfaces intersecting a corresponding one of the side edges of each of the end faces, the angled side surfaces parallel to one another and intersecting the top surface and the bottom surface at the angle a measuring about 20–25 degrees relative to a reference line extending perpendicular to the top and bottom surfaces;

a plurality of vertically stacked parallelepiped layers arranged to form the game piece stack, each of the plurality of layers comprising a plurality of the primary game pieces disposed immediately adjacent one another with the angled side surface of a first primary game piece nested against and confronting the angled side surface of the next adjacent primary game piece such that a portion of the first primary game piece overlies a portion of the second primary game piece in the same layer by a distance equal to the offset distance D;

the primary game pieces and the stacked plurality of layers arranged to permit at least one of the primary game pieces in a selected layer to be selectively removable from the game piece stack so as to leave at least the second primary game piece in the selected layer in place thereby altering a tipping moment of the still-standing game piece stack; and wherein the end faces are separated by a distance L, the rectangular top and bottom surfaces have a width W measured perpendicular to the distance L, and the top and bottom rectangular surfaces are separated from one another by a distance H, and further wherein a ratio of L to W is about 3:1, and wherein a ratio of W to H is about 2:1.

* * * * *

UNITED STATES PATENT AND TRADEMARK OFFICE

CERTIFICATE OF CORRECTION

PATENT NO. : 7,059,606 B2
APPLICATION NO. : 10/713396
DATED : June 13, 2006
INVENTOR(S) : Stephen W. Butcher et al.

It is certified that error appears in the above-identified patent and that said Letters Patent is hereby corrected as shown below:

In the Claims:

At Column 12, lines 16-17, please delete "α, or each" and insert --α, each--.

At Column 12, line 29, please delete "first of a primary" and insert --first primary--.

At Column 12, line 42, please delete "layers ; and" and insert --layers; and--.

At Column 12, line 54, please delete "of W toll" and insert --of W to H--.

At Column 14, line 21, please delete "angle a" and insert --angle α--.

Signed and Sealed this

Seventh Day of August, 2007

JON W. DUDAS
*Director of the United States Patent and Trademark Office*